US007805935B2

(12) United States Patent
Yaguchi et al.

(10) Patent No.: US 7,805,935 B2
(45) Date of Patent: Oct. 5, 2010

(54) STIRLING ENGINE AND CONTROL METHOD THEREFOR

(75) Inventors: Hiroshi Yaguchi, Susono (JP); Daisaku Sawada, Gotenba (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 342 days.

(21) Appl. No.: 11/959,065

(22) Filed: Dec. 18, 2007

(65) Prior Publication Data

US 2008/0163620 A1 Jul. 10, 2008

(30) Foreign Application Priority Data

Jan. 9, 2007 (JP) ..... 2007-001712

(51) Int. Cl.
*F01B 29/10* (2006.01)

(52) U.S. Cl. ..... 60/521; 60/522; 60/524

(58) Field of Classification Search ..... 60/517–526
See application file for complete search history.

(56) References Cited

U.S. PATENT DOCUMENTS 5,755,100 A * 5/1998 Lamos ..... 60/521
7,581,393 B2 * 9/2009 Yaguchi et al. ..... 60/521

FOREIGN PATENT DOCUMENTS

JP 11-247715 9/1999
JP 2005-106009 4/2005
JP 2006-348893 12/2006

* cited by examiner

*Primary Examiner*—Hoang M Nguyen
(74) *Attorney, Agent, or Firm*—Oblon, Spivak, McClelland, Maier & Neustadt, L.L.P.

(57) ABSTRACT

In a Stirling engine, a casing houses therein component elements of the Stirling engine, including a high-temperature-side cylinder, a high-temperature-side piston, a connecting rod, a crankshaft, etc. A pressure control device determines whether the pressure of the gas charged in the casing has declined. If the pressure of the gas has declined, the pressure control device drives a pump to pressurize the gas charged in the casing.

9 Claims, 6 Drawing Sheets

FIG. 7

45

| T | T1 | T2 | ··· | Tm | ··· | Tn |
|---|---|---|---|---|---|---|
| Pc | Pc1 | Pc2 | ··· | Pcm | ··· | Pcn |

STIRLING ENGINE AND CONTROL METHOD THEREFOR

INCORPORATION BY REFERENCE

The disclosure of Japanese Patent Application No. 2007-001712 filed on Jan. 9, 2007, including the specification, drawings and abstract is incorporated herein by reference in its entirety.

BACKGROUND OF THE INVENTION

1. Field of Invention

The invention relates to a piston engine in which a piston reciprocates within a cylinder.

2. Description of Related Art

In recent years, Stirling engines, which are excellent in the theoretical heat efficiency, are drawing attention for the recovery of exhaust heat of an internal combustion engine mounted in a vehicle, such as a passenger car, a bus, a truck, etc., or of factory waste heat. Japanese Patent Application Publication No. 2005-106009 (JP-A-2005-106009) discloses a Stirling engine in which high pressure is maintained within a crankcase in order to obtain high output from the Stirling engine.

However, as for the Stirling engine disclosed in Japanese Patent Application Publication No. 2005-106009 (JP-A-2005-106009), no consideration is given to, for example, the pressure decline of the gas charged in the crankcase (casing) due to leakage of the gas.

SUMMARY OF THE INVENTION

It is an object of the invention to substantially prevent a Stirling engine in which pressurization in a casing is performed from undergoing the decline in the output caused by a decline in the pressure of the gas charged in the casing.

A first aspect of the invention relates to a Stirling engine. This Stirling engine includes: a casing that houses at least one component element of the Stirling engine; a determination device that determines whether pressure of a gas charged within the casing has declined based on an index that represents a targeted pressure of the gas; and a pressure adjustment device that compensates for a decline in the pressure of the gas by pressurizing the gas. Here, the gas may be air.

The at least one component element may include: a cylinder; a piston supported in the cylinder via a gas bearing; and an approximately linear mechanism that supports the piston.

Therefore, even if there occurs a decline in the pressure of the gas within the casing due to a change in the operation environment or leakage, the decline in the pressure can be compensated for by the pressure adjustment device. As a result, it is possible to restrain the decline in the output of the Stirling engine caused by a decline in the pressure of the gas charged in the casing.

The index may be the pressure of the gas charged in the casing which is determined based on temperature of the gas, and the pressure adjustment device may pressurize the gas so that the pressure of the gas reaches the index.

The index may be determined based on a ratio of the pressure of the gas to temperature of the gas or a ratio of temperature of the gas to the pressure of the gas, and the pressure adjustment device may pressurize the gas so that the ratio of the pressure of the gas to the temperature of the gas or the ratio of the temperature of the gas to the pressure of the gas reaches the index.

In the foregoing construction, before the Stirling engine is started, the determination device may determine whether the pressure of the gas has declined.

The index may be the pressure of the gas charged in the casing which occurs when the Stirling engine produces an output that is determined from a specification of the Stirling engine.

A second aspect of the invention relates to a Stirling engine. This Stirling engine includes: a cylinder; a piston supported in the cylinder via a gas bearing; an approximately linear mechanism that supports the piston; a casing that houses the cylinder, the piston and the approximately linear mechanism; a determination device that determines whether pressure of a gas charged in the casing has declined based on an index that represents a targeted pressure of the gas; and a pressure adjustment device that pressurizes the gas.

Therefore, even if there occurs a decline in the pressure of the gas within the casing due to a change in the operation environment or leakage, the decline in the pressure can be compensated for by the pressure adjustment device. As a result, it is possible to restrain the decline in the output of the Stirling engine caused by a decline in the pressure of the gas charged in the casing. Besides, due to the gas bearing and the approximately linear mechanism, the friction loss between the piston and the cylinder can be reduced, and therefore the decline in the output can be more effectively restrained.

A third aspect of the invention relates to a Stirling engine control method. This Stirling engine control method includes: the step of determining whether pressure of a gas charged in a casing that houses at least one component element of a Stirling engine has declined based on an index that represents a targeted pressure of the gas; and the step of compensating for a decline in the pressure of the gas by pressurizing the gas.

According to the Stirling engine and the Stirling engine control method in the foregoing aspects, in a Stirling engine in which the gas charged in the casing is pressurized, it is possible to restrain the decline in the output of the engine caused by a decline in the pressure of the gas charged in the casing.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein:

FIG. 7 is a conceptual diagram showing a pressure target value determination map for use in the pressure control in accordance with the embodiment.

DETAILED DESCRIPTION OF THE EMBODIMENTS

The invention will be described in detail hereinafter with reference to the drawings.

An embodiment of the invention is characterized in the following respects. That is, the embodiment is a Stirling engine in which the gas charged within a casing that houses component elements of the Stirling engine is pressurized beforehand. In this Stirling engine, it is determined whether or not the pressure of the gas has declined on the basis of an index that represents a targeted pressure of the gas charged in the casing. Then, if the pressure of the gas is lower than the pressure found from the index, the gas is pressurized to compensate for the amount of decline in the pressure of the gas from the pressure target value. Firstly, a construction of a Stirling engine in accordance with the invention will be described. Incidentally, the following description will be made in conjunction with an example where the Stirling engine is used as an exhaust heat recovery device to recover thermal energy from exhaust gas discharged from an internal combustion engine, which is a heat engine. Incidentally, the heat engine may be of any kind. Here, air may be used as the gas.

Figure 1:
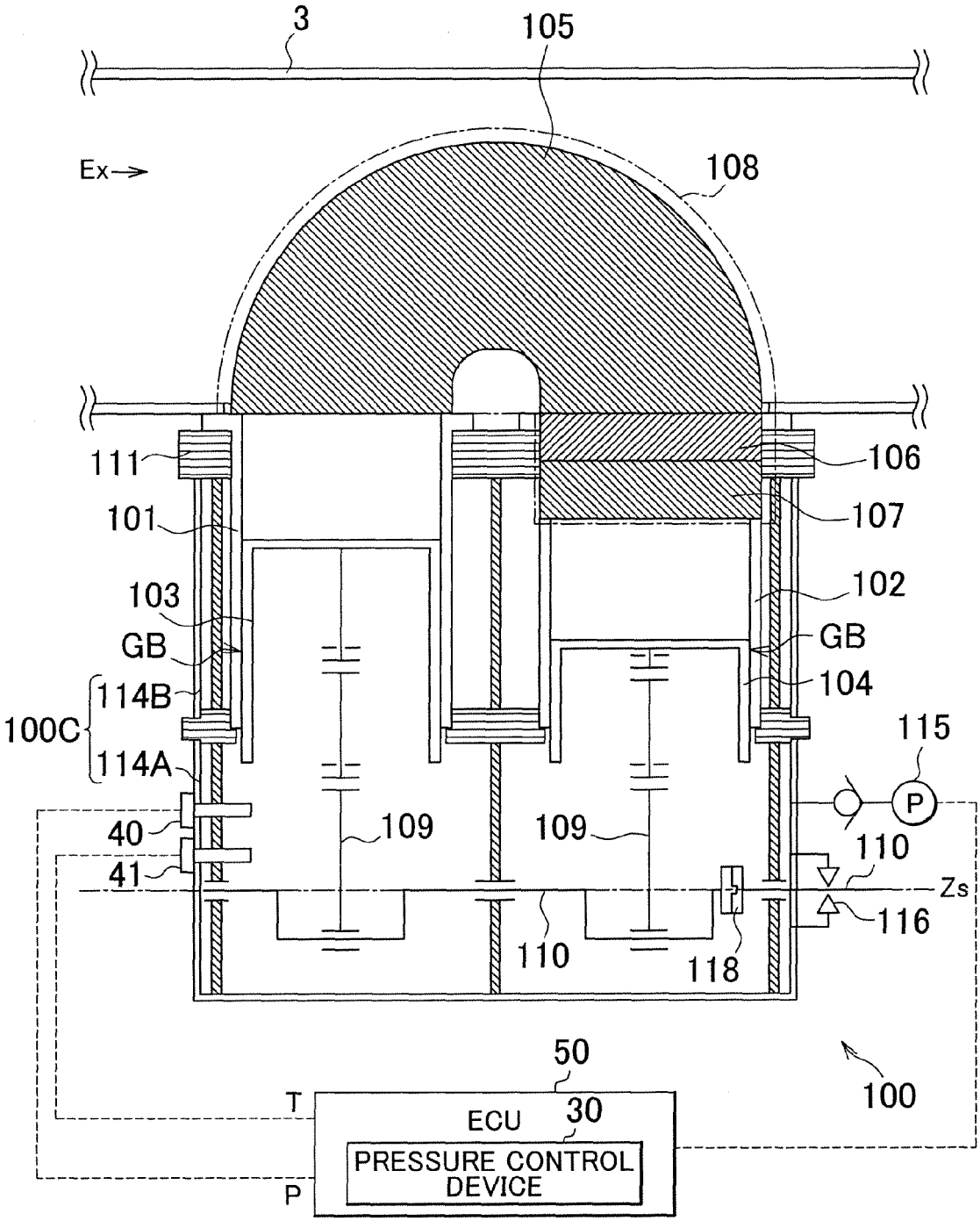
FIG. 1 is an illustrative diagram showing a section of a Stirling engine in accordance with an embodiment of the invention.
Figure 2:
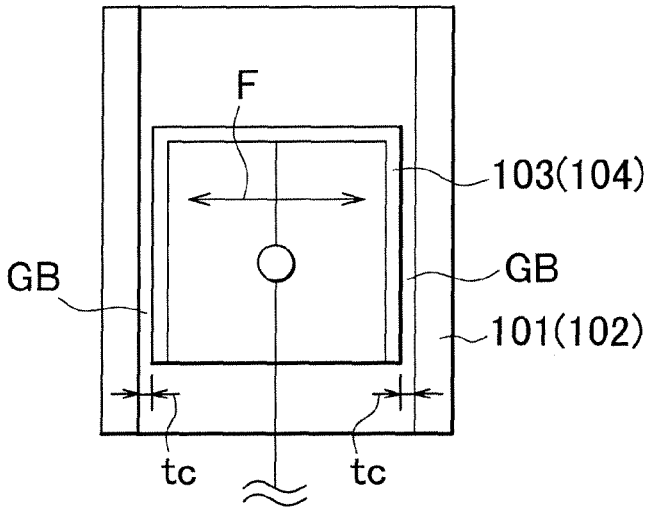
FIG. 2 is an illustrative diagram showing a section of an example of a construction of an air bearing provided in the Stirling engine in accordance with the embodiment.
Figure 3:
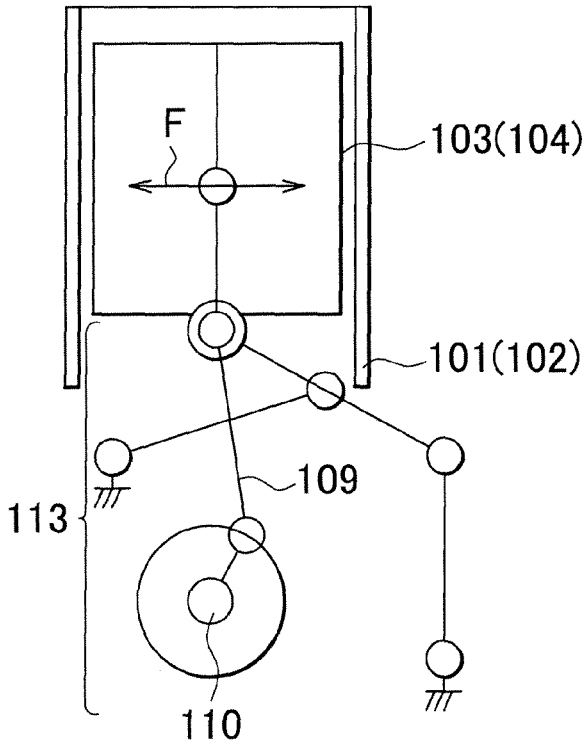
FIG. 3 is an illustrative diagram showing an approximately linear mechanism that supports pistons of the Stirling engine in accordance with the embodiment.

FIG. 1 is an illustrative diagram showing a section of a Stirling engine in accordance with this embodiment. FIG. 2 is an illustrative diagram showing a section of an example of a construction of an air bearing provided in the Stirling engine in accordance with this embodiment. FIG. 3 is an illustrative diagram showing an approximately linear mechanism that supports pistons of the Stirling engine in accordance with the embodiment. A Stirling engine 100 that is an exhaust heat recovery device in accordance with this embodiment is a so-called α-type in-series two-cylinder Stirling engine. That is, a high-temperature-side piston 103 termed a first piston which is contained in a high-temperature-side cylinder 101 termed a first cylinder, and a low-temperature-side piston 104 termed a second piston which is contained in a low-temperature-side cylinder 102 termed a second cylinder are arranged in series.

The high-temperature-side cylinder 101 and the low-temperature-side cylinder 102 are directly or indirectly supported by and fixed to a base board 111 that is a reference body. In the Stirling engine 100 in accordance with this embodiment, the base board 111 serves as a positional reference for various component elements of the Stirling engine 100. This construction secures accuracy of the relative positions of the component elements. Besides, in the Stirling engine 100 in accordance with this embodiment, a gas bearing GB is interposed between the high-temperature-side cylinder 101 and the high-temperature-side piston 103 and also between the low-temperature-side cylinder 102 and the low-temperature-side piston 104. More specifically, the high-temperature-side piston 103 and the low-temperature-side piston 104 are disposed in series in the direction in which a crankshaft 110 extends.

In the Stirling engine in accordance with the embodiment, since the high-temperature-side cylinder 101 and the low-temperature-side cylinder 102 are mounted directly or indirectly on the base board 111, which is the reference body, the clearance between the piston and the cylinder can be accurately maintained. This allows the function of each gas bearing GB to be fully performed. Besides, this facilitates the assembly of the Stirling engine 100.

A heat exchanger 108 constructed of a generally U-shape heater 105, a regenerator 106 and a cooler 107 is disposed between the high-temperature-side cylinder 101 and the low-temperature-side cylinder 102. Since the heater 105 has a generally U-shape, the heater 105 cab easily be disposed even in such a relatively narrow space as an exhaust gas passageway of an internal combustion engine. Besides, as in this Stirling engine 100, the series arrangement of the high-temperature-side cylinder 101 and the low-temperature-side cylinder 102 makes it relatively easy to dispose the heater 105 even in such a tubular space as the exhaust gas passageway of the internal combustion engine.

One of two end portions of the heater 105 is disposed on a high-temperature-side cylinder 101 side, and the other end portion thereof is disposed on a regenerator 106 side. One of two end portions of the regenerator 106 is disposed on the heater 105 side, and the other end portion thereof is disposed on a cooler 107 side. One of two end portions of the cooler 107 is disposed on the regenerator 106 side, and the other end portion thereof is disposed on a low-temperature-side cylinder 102 side.

A working fluid (air in this embodiment) is enclosed in the high-temperature-side cylinder 101, the low-temperature-side cylinder 102 and the heat exchanger 108. The heat supplied from the heater 105 and the heat discharged from the cooler 107 constitute the Stirling cycle, and thus drives the Stirling engine 100. It is to be noted herein that, for example, the heater 105 and the cooler 107 can each be constructed of bundling a plurality of tubes made of a material that is high in thermal conductivity and excellent in heat resistance. The cooler 107 may be of an air-cooled type or of a water-cooled type. Besides, the regenerator 106 can be constructed of a porous thermal storage body. Incidentally, the construction of each of the heater 105, the cooler 107 and the regenerator 106 is not limited to the foregoing examples. Instead, any preferred construction can be selected depending on the thermal conditions of an object of the exhaust heat recovery, the specifications of the Stirling engine 100, etc.

The high-temperature-side piston 103 and the low-temperature-side piston 104 are supported within the high-temperature-side cylinder 101 and the low-temperature-side cylinder 102, respectively, via the gas bearings GB. That is, the pistons are supported within the cylinders without using a piston ring therebetween. This structure reduces the friction between the pistons and the cylinders, and improves the exhaust heat recovery efficiency of the Stirling engine 100. Besides, if the friction between the pistons and the cylinders is reduced, it becomes easier to operate the Stirling engine 100 to recover thermal energy from exhaust heat in the form of kinetic energy even under operation conditions of a low heat source and a small temperature difference, such as the conditions in the case of the exhaust heat recovery in an internal combustion engine.

To construct the gas bearing GB, a clearance tc between the high-temperature-side piston 103 and the high-temperature-side cylinder 101 is set at several ten μm throughout the circumference of the high-temperature-side piston 103 or the like as shown in FIG. 2. The low-temperature-side piston 104 and the low-temperature-side cylinder 102 are arranged in substantially the same manner. The high-temperature-side cylinder 101, the high-temperature-side piston 103, the low-temperature-side cylinder 102 and the low-temperature-side piston 104 can be constructed, for example, by using a metal material that is easy to machine.

The reciprocating motion of each of the high-temperature-side piston 103 and the low-temperature-side piston 104 are transmitted by a connecting rod 109 to a crankshaft 110 that is an output shaft, and is thereby converted into rotary motion. In this embodiment, the high-temperature-side piston 103 and the low-temperature-side piston 104 are supported by an approximately linear mechanism (e.g., a grasshopper mechanism) 113 shown in FIG. 3. In this manner, the high-temperature-side piston 103 and the low-temperature-side piston 104 can be reciprocated approximately linearly. As a result, the side force F on the high-temperature-side piston 103 (i.e., the force directed in a direction of the diameter of the piston) becomes substantially zero. Therefore, the piston can be sufficiently supported even by the gas bearing GB, which is low in the ability to withstand the side force.

As shown in FIG. 1, the component elements constituting the Stirling engine 100, including the high-temperature-side cylinder 101, the high-temperature-side piston 103, the connecting rod 109, the crankshaft 110, etc., are housed in a casing 100C. The casing 100C of the Stirling engine 100 includes a crankcase 114A and a cylinder block 114B. The gas charged in the casing 100C (which is the same as the working fluid in this embodiment) is pressurized by a pump 115. This pump 115 can be regarded as a pressure adjustment device in the invention. The pump 115 may be driven by, for example, an internal combustion engine that is the object of the exhaust heat recovery of the Stirling engine 100, or may also be driven by using an electric motor or the like.

As for the Stirling engine 100, the higher the average pressure of the working fluid, the greater the pressure difference between the high-temperature-side and the low-temperature-side is, and therefore the higher output is obtained, provided that the temperature difference between the heater 105 and the cooler 107 is fixed. The Stirling engine 100 in accordance with the embodiment is constructed so that a greater amount of output can be taken out from the Stirling engine 100 by pressurizing the gas charged in the casing 100C so as to maintain high pressure of the working fluid. This construction makes it possible to take out a greater amount of output from the Stirling engine 100 even in the case where only low-quality heat source can be used as in the case of exhaust heat recovery. Incidentally, the output of the Stirling engine 100 increases substantially in proportion to the pressure of the gas charged in the casing 100C.

In the Stirling engine 100 in accordance with the embodiment, a seal bearing 116 is mounted on the casing 100C, and the seal bearing 116 supports the crankshaft 110. In the Stirling engine 100 in accordance with the embodiment, although the gas charged in the casing 100C is pressurized, the seal bearing 116 minimizes the leakage of the gas charged in the casing 100C. The output of the crankshaft 110 is taken to the outside of the casing 100C via a flexible coupling 118, such as an Oldham's coupling.

The operation of the pump 115 is controlled by a pressure control device 30 provided in an engine ECU (Electronic Control Unit) 50. The pressure of the gas charged in the casing 100C is measured by a pressure sensor 40 that is a pressure detection portion. The temperature of the gas charged in the casing 100C is measured by a temperature sensor 41 that is a temperature detection portion. The pressure P and the temperature T of the gas charged in the casing 100C which are measured by the pressure sensor 40 and the temperature sensor 41 are taken into the pressure control device 30 provided in the engine ECU 50, and are used for the pressure control of the gas charged in the casing 100C.

In the Stirling engine 100 in accordance with the embodiment, the leakage of the gas charged in the casing 100C is minimized by the seal bearing 116, but slight leakage occurs. Therefore, as time passes, the pressure P of the gas charged in the casing 100C declines. Besides, the pressure P of the gas charged in the casing 100C may also decline depending on the operation environment of the Stirling engine 100.

For example, if the temperature of the operation environment of the Stirling engine 100 declines and therefore the temperature T of the gas charged in the casing 100C declines, then the pressure P of the gas charged in the casing 100C also declines. If the pressure P of the gas charged in the casing 100C declines, the output of the Stirling engine 100 declines. In order to avoid the decline in the output of the Stirling engine 100, there is a need to keep the pressure P of the gas charged in the casing 100C at a predetermined value.

In this embodiment, in the case where the pressure P of the gas charged in the casing 100C declines below a pre-determined pressure target value, an amount of the gas is supplied into the casing 100C by the pump 115 so as to raise the pressure P of the gas charged in the casing 100C to the pressure target value. This restrains the decline in the output of the Stirling engine 100 caused by leakage or a change in the operation environment. The pressure target value is an index that represents a targeted pressure of the gas charged in the casing 100C, and may be set, for example, at the pressure of the gas charged in the casing 100C in a standard operation state of the Stirling engine 100. Incidentally, the standard operation state of the Stirling engine 100 refers to, for example, a state where the Stirling engine 100 is producing the output that is determined from the specifications of the Stirling engine 100.

Figure 4:
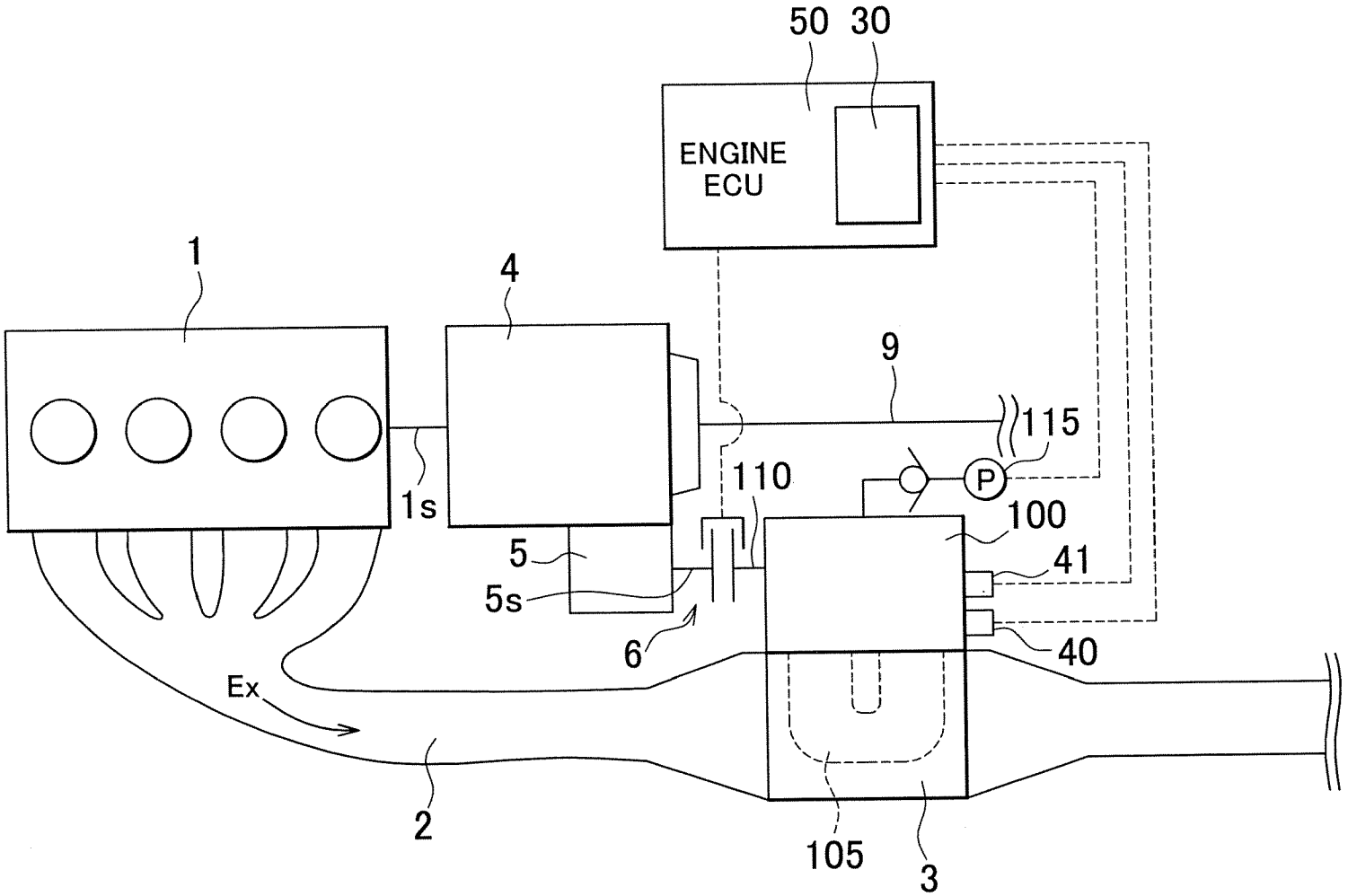
FIG. 4 is a schematic diagram showing an example of a construction in which a Stirling engine in accordance with the embodiment is employed for the recovery of exhaust heat from an internal combustion engine.

FIG. 4 is a schematic diagram showing an example of a construction in which a Stirling engine in accordance with the embodiment is employed for the recovery of exhaust heat from an internal combustion engine. In this embodiment, the output of the Stirling engine 100 is input to an internal combustion engine transmission 4 via a Stirling engine transmission 5, and is therefore combined with the output of the internal combustion engine 1, and the combined power is taken out.

In this embodiment, the internal combustion engine 1 is mounted in, for example, a vehicle such as a passenger car, a truck or the like, to serve as a motive power source of the vehicle. The internal combustion engine 1 produces output as a main motive power source during run of the vehicle. On the other hand, the Stirling engine 100 is not able to provide a minimum necessary output until the temperature of exhaust gas EX reaches a certain level of temperature. Therefore, in this embodiment, after the temperature of the exhaust gas EX discharged by the internal combustion engine 1 exceeds a predetermined temperature, the Stirling engine 100 recovers thermal energy from the exhaust gas EX of the internal combustion engine 1 and produces output so as to drive the vehicle in cooperation with the internal combustion engine 1. In this manner, the Stirling engine 100 serves as a subsidiary motive power source of the vehicle.

The heater 105 of the Stirling engine 100 is disposed in an exhaust passageway 2 of the internal combustion engine 1. Incidentally, in the exhaust passageway 2, the regenerator (see FIG. 1) 106 of the Stirling engine 100 may also be disposed. The heater 105 of the Stirling engine 100 is provided in a hollow heater case 3 that is provided on the exhaust passageway 2.

In this embodiment, the thermal energy of exhaust gas EX recovered through the use of the Stirling engine 100 is converted into kinetic energy by the Stirling engine 100. A clutch 6 that is a power connection-disconnection device is attached to the crankshaft 110, which is an output shaft of the Stirling engine 100. Thus, the output of the Stirling engine 100 is transmitted to the Stirling engine transmission 5 via the clutch 6.

The output of the internal combustion engine 1 is input to the internal combustion engine transmission 4 via an output shaft 1*s* of the internal combustion engine 1. Then, the internal combustion engine transmission 4 combines the output of the internal combustion engine 1 and the output of the Stirling engine 100 input thereto via the Stirling engine transmission 5, and outputs the combined power to a transmission output shaft 9. The clutch 6, which is the power connection-disconnection device, is provided between the internal combustion engine transmission 4 and the Stirling engine 100. In this embodiment, the clutch 6 is provided between an input shaft 5*s* of the Stirling engine transmission 5 and the crankshaft 110 of the Stirling engine 100. The clutch 6 is engaged and disengaged to establish and remove the mechanical connection between the crankshaft 110 of the Stirling engine 100 and the input shaft 5*s* of the Stirling engine transmission 5. Incidentally, the clutch 6 is controlled by an engine ECU 50.

The Stirling engine 100 recovers thermal energy of the exhaust gas EX discharged by the internal combustion engine 1. Incidentally, in the case where the temperature of the exhaust gas EX is low, for example, at the time of cold start of the internal combustion engine 1, or the like, thermal energy cannot be recovered from the exhaust gas EX, and therefore the Stirling engine 100 does not produce output. Therefore, until it becomes possible for the Stirling engine 100 to produce output, the clutch 6 is disengaged to disconnect the Stirling engine 100 and the internal combustion engine 1 from each other. Thus, the energy loss due to the Stirling engine 100 being driven by the internal combustion engine 1 is restrained.

When the clutch 6 is engaged, the crankshaft 110 of the Stirling engine 100 and the output shaft 1*s* of the internal combustion engine 1 are directly linked via the Stirling engine transmission 5 and the internal combustion engine transmission 4. As a result of this, the output produced by the Stirling engine 100 and the output produced by the internal combustion engine 1 are combined by the internal combustion engine transmission 4, and the combined power is taken out via the transmission output shaft 9. On the other hand, when the clutch 6 is disengaged, the output shaft 1*s* of the internal combustion engine 1 rotates disconnected from the crankshaft 110 of the Stirling engine 100. Next, the construction of the pressure control device 30 will be described.

Figure 5:
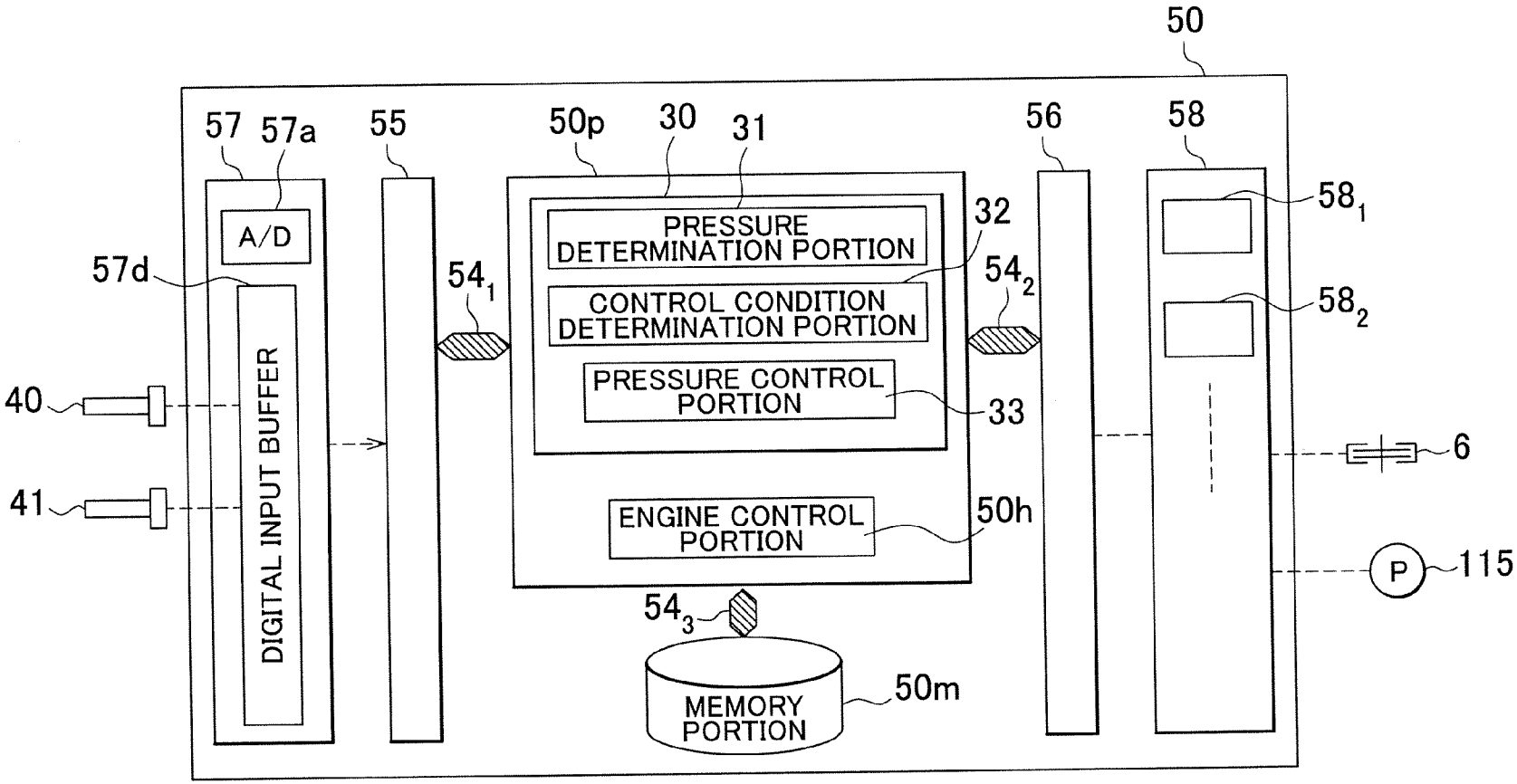
FIG. 5 is an illustrative diagram showing a pressure control device in accordance with the embodiment.

FIG. 5 is an illustrative diagram showing a pressure control device in accordance with the embodiment. As shown in FIG. 5, the pressure control device 30 in accordance with the embodiment is incorporated into the engine ECU 50. The engine ECU 50 is constructed of a CPU (Central Processing Unit) 50*p*, a memory portion 50*m*, an input port 55, an output port 56, an input interface 57, and an output interface 58.

Incidentally, a pressure control device 30 in accordance with the embodiment may instead be provided separately from the engine ECU 50, and may be connected to the engine ECU 50. Then, in order to realize the pressure control of the gas charged in the casing 100C of the Stirling engine 100 in accordance with the embodiment, it is possible to provide a construction in which the control functions the engine ECU 50 has for the Stirling engine 100 and the like are allowed to be used by the pressure control device 30.

The pressure control device 30 includes a pressure determination portion 31, a control condition determination portion 32, and a pressure control portion 33. These portions form portions that execute operation controls in accordance with the embodiment. In the embodiment, the pressure control device 30 is constructed as a portion of the CPU 50*p* that constitutes the engine ECU 50. Besides, the CPU 50*p* is provided with an engine control portion 50*h*, whereby the operation of the internal combustion engine 1 and the Stirling engine 100 is controlled.

The CPU 50*p*, the memory portion 50*m*, the input port 55 and the output port 56 are interconnected via buses $\mathbf{54}_1$ to $\mathbf{54}_3$. Therefore, the pressure determination portion 31, the control condition determination portion 32 and the pressure control portion 33 that constitute the pressure control device 30 can exchange control data with each other, and can output a command to an appropriate one of these portions. Besides, the pressure control device 30 can acquire operation control data that the engine ECU 50 has regarding the internal combustion engine 1, the Stirling engine 100, etc., and can use the data. Besides, the pressure control device 30 can interrupt an operation control routine set beforehand in the engine ECU 50 with the operation control in accordance with the embodiment.

The input interface 57 is connected to the input port 55. Sensors and the like necessary for the control of maintaining a predetermined pressure of the gas charged in the casing 100C of the Stirling engine 100 are connected to the input interface 57. In this embodiment, these sensors and the like include the pressure sensor 40, and the temperature sensor 41. In addition, the sensors and the like connected to the input interface 57 also include sensors and the like provided for acquiring information necessary for the operation control of the internal combustion engine 1 and the Stirling engine 100, and the control of the internal combustion engine transmission 4 and the Stirling engine transmission 5.

The signals from these sensors and the like are converted by an A/D converter 57*a* and a digital input buffer 57*d* in the input interface 57 into signals usable by the CPU 50*p*, which are sent to the input port 55. Therefore, the CPU 50*p* can acquire information necessary for the operation control of the internal combustion engine 1 and the pressure control of the gas charged in the casing 100C.

The output interface 58 is connected to the output port 56. Control objects necessary for the control of maintaining a predetermined pressure of the gas charged in the casing 100C of the Stirling engine 100 are connected to the output interface 58. In this embodiment, these control objects include the pump 115. Other control objects connected to the output interface 58 are control objects (e.g., the clutch 6) necessary for the operation control of the internal combustion engine 1 and the Stirling engine 100, and the control of the internal combustion engine transmission 4 and the Stirling engine transmission 5.

The output interface 58 has control circuits $\mathbf{58}_1$, $\mathbf{58}_2$, and the like, causes the control objects to operate on the basis of the control signal generated through the computation performed by the CPU 50*p*. Due to the construction as described above, on the basis of the output signals of the foregoing sensors and the like, the CPU 50*p* of the engine ECU 50 can control the pump 115 and the clutch 6 as well as the Stirling engine 100, the internal combustion engine 1, etc.

The memory portion 50*m* stores computer programs, including a processing procedure of the pressure control in accordance with the embodiment, as well as data maps and the like. Incidentally, the memory portion 50*m* may be constructed of a volatile memory, such as a RAM (Random Access Memory), a non-volatile memory, such as a flash memory or the like, or a combination of such memories.

The computer programs may be programs that realize a processing procedure of the pressure control in accordance with the embodiment by combining with a computer program recorded beforehand in the CPU 50*p*. Besides, the pressure control device 30 may also realize the functions of the pressure determination portion 31, the control condition determination portion 32 and the pressure control portion 33 by using dedicated hardware devices or the like instead of the computer programs. Next, the pressure control in accordance with the embodiment will be described. The pressure control in accordance with the embodiment can be realized by the pressure control device 30. The next description will be best understood with appropriate reference to FIGS. 1 to 5.

Figure 6:
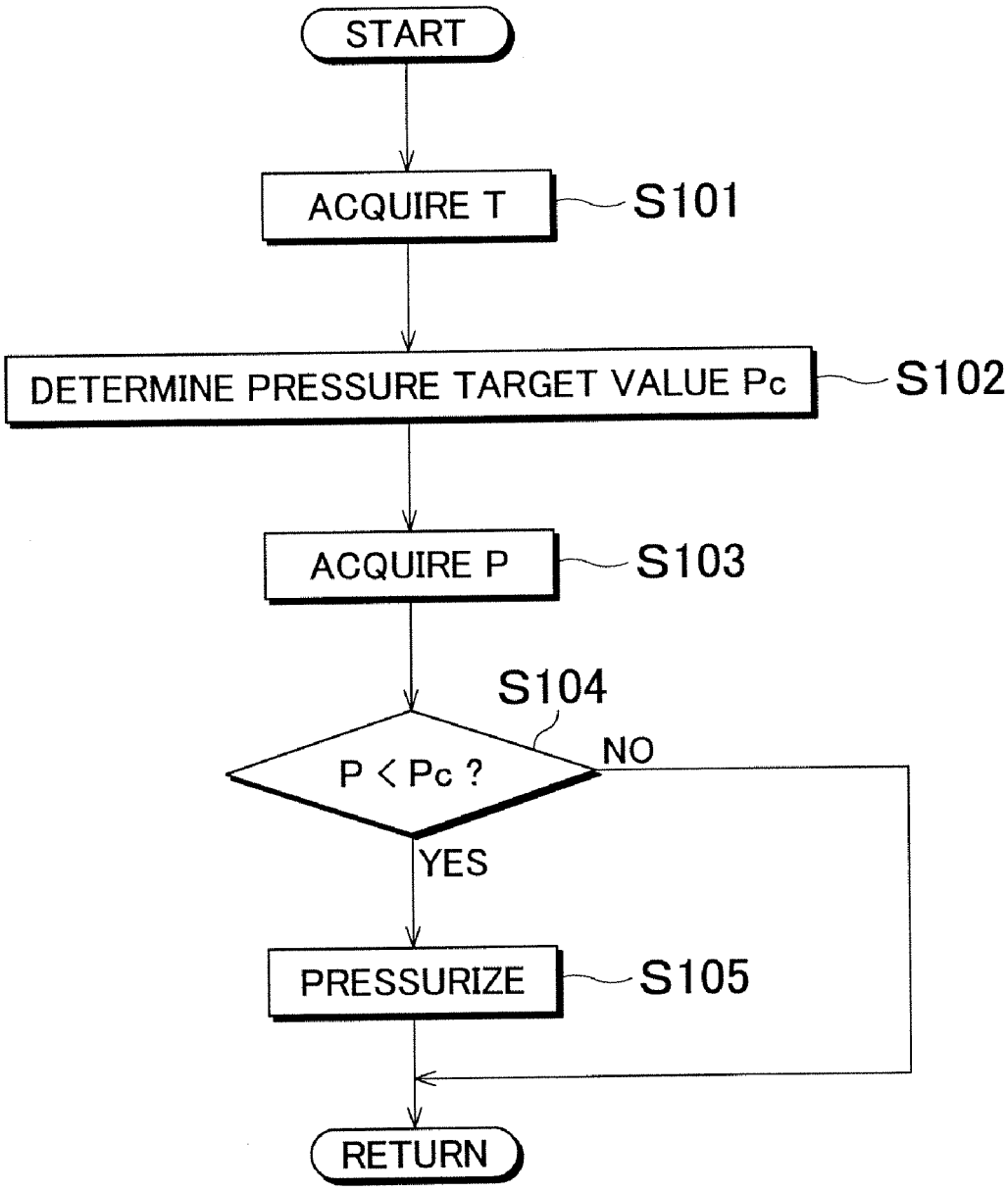
FIG. 6 is a flowchart showing a procedure of a pressure control in accordance with the embodiment.

FIG. 6 is a flowchart showing a procedure of the pressure control in accordance with the embodiment. FIG. 7 is a conceptual diagram showing a pressure target value determination map for use in the pressure control in accordance with the embodiment. The pressure control in accordance with the embodiment described below is executed before the Stirling engine 100 is started. However, the pressure control may also be executed during operation of the Stirling engine 100. If the pressure control is executed before the Stirling engine 100 is started, a pre-established output can be secured immediately after the Stirling engine 100 is started.

In order to execute the pressure control in accordance with the embodiment, the pressure determination portion 31 of the pressure control device 30, in step S101, acquires the temperature T of the gas charged in the casing 100C of the Stirling engine 100 (hereinafter, termed the gas actual temperature) from the temperature sensor 41 shown in FIGS. 1 and 4.

In step S102, the pressure determination portion 31 determines a pressure target value Pc. As described above, the pressure target value is the pressure of the gas charged in the casing 100C during the standard operation state. To determine the pressure target value, the pressure determination portion 31 gives the gas actual temperature T acquired in step S101 to a pressure target value determination map 45 shown in FIG. 7, and thus acquires a corresponding pressure target value Pc. For example, if the actual pressure of the gas charged in the casing 100C is a pressure target value Pm in the case where the temperature of the gas charged in the casing 100C is Tm, the Stirling engine 100 can produce a pre-established output. Incidentally, the pressure target value determination map 45 is stored in the memory portion 50*m* of the engine ECU 50.

In the pressure target value determination map 45, combinations of the pressure target value Pc and the temperature T of the gas charged in the casing 100C during the standard operation state are described in accordance with a plurality of conditions. In this embodiment, for example, the temperature T is described as $T1<T2<\ldots<Tm<\ldots<Tn$, and the pressure target value Pc is described as $Pc1>Pc2>\ldots>Pcm>\ldots>Pcn$. That is, the greater the temperature T, the smaller the pressure target value Pc is set. Incidentally, the temperature T and the pressure target value Pc of the gas charged in the casing 100C during the standard operation state are not limited to the setting provided in the pressure target value determination map 45. Besides, since the temperature T and the pressure target value Pc are discretely described, a temperature T that is not described in the pressure target value determination map 45 requires, for example, linear interpolation, in order to determine a corresponding pressure target value Pc.

By determining the pressure target value Pc through the use of the temperature of the gas charged in the casing 100C in this manner, the pressure P of the gas charged in the casing 100C can be controlled with higher accuracy. As a result, insufficient pressurization can be restrained, and therefore the decline in the output of the Stirling engine 100 can be more reliably restrained. Besides, since excessive pressurization can also be restrained, the unnecessary driving of the pump 115 can be avoided to restrain the energy consumption.

The pressure P of the gas charged in the casing 100C may also be controlled on the basis of the ratio between the pressure P and the temperature T of the gas in the casing 100C (termed the pressure/temperature ratio) P/T. For example, if a pressure target value Pc_p is targeted at a temperature Tc_p, the ratio P/T is Pc_p/Tc_p=A (constant). This constant A is set beforehand on the basis of the ratio between the pressure P and the temperature T of the gas in the casing 100C, and is an index representing a targeted pressure of the pressure P of the gas charged in the casing 100C. Here, the temperature T may be expressed as an absolute temperature. Hereinafter, the constant A will be termed the pressure target index.

In the case where the pressure P of the gas charged in the casing 100C is controlled through the use of the pressure/temperature ratio P/T, the pressure determination portion 31 finds the pressure/temperature ratio P/T at the present time point from the pressure P and the temperature T of the gas charged in the casing 100C which are acquired from the pressure sensor 40 and the temperature sensor 41. Then, the pressure control portion 33 of the pressure control device 30 controls the pressure P of the gas charged in the casing 100C so that the ratio P/T at the present time point becomes greater than or equal to the pressure target index A. Therefore, the pressure P of the gas charged in the casing 100C can be maintained at or above the foregoing pressure target value Pc.

Besides, the pressure P of the gas charged in the casing 100C may also be controlled on the basis of the ratio between the temperature T and the pressure P of the gas in the casing 100C (termed the temperature/pressure ratio) T/P. For example, if a pressure Pc_p is targeted at a temperature Tc_p, the ratio T/P is Tc_p/Pc_p=B (constant). This constant B is set beforehand on the basis of the ratio between the pressure P and the temperature T of the gas in the casing 100C, and is an index representing a targeted pressure of the pressure P of the gas charged in the casing 100C. Hereinafter, the constant B will be termed the pressure target index.

In the case where the pressure of the gas in the casing 100C is controlled through the use of the temperature/pressure ratio T/P, the pressure determination portion 31 finds the temperature/pressure ratio T/P at the present time point from the pressure P and the temperature T of the gas charged in the casing 100C which are acquired from the pressure sensor 40 and the temperature sensor 41. Then, the pressure control portion 33 controls the pressure P of the gas in the casing 100C so that the ratio T/P at the present time point becomes less than or equal to the pressure target index B. Therefore, the pressure P of the gas in the casing 100C can be maintained at or above the foregoing pressure target value Pc.

Thus, in this embodiment, the pressure P of the gas charged in the casing 100C can also be controlled on the basis of the pressure/temperature ratio P/T or the temperature/pressure ratio T/P and on the basis of the pre-set pressure target index. This manner of control eliminates the need to use the pressure target value determination map 45, and therefore curbs the use of the memory portion 50*m* provided in the engine ECU 50. Besides, the time and trouble taken to create the pressure target value determination map 45 can also be lessened.

After the in-casing gas pressure during the standard operation state is determined, the control condition determination portion 32 of the pressure control device 30, in step S103, acquires the pressure P of the gas charged in the casing 100C of the Stirling engine 100 (termed the gas actual pressure) P from the pressure sensor 40 shown in FIGS. 1 and 4. Incidentally, the control condition determination portion 32 can be regarded as a determination device in the invention. In step S104, the control condition determination portion 32 compares the gas actual pressure P acquired in step S103 with the pressure target value Pc determined in step S102.

If the answer to the determination in step S104 is "YES", that is, if the control condition determination portion 32 determines P<Pc, the Stirling engine 100 cannot produce the pre-established output. Therefore, in step S105, the pressure control portion 33 of the pressure control device 30 drives the pump 115 shown in FIGS. 1 and 4 to pressurize the gas charged in the casing 100C of the Stirling engine 100.

In the case where the gas charged in the casing 100C is pressurized, the pressurization by the pump 115 is continued until the pressure of the gas charged in the casing 100C, which is detected by, for example, the pressure sensor 40, reaches the pressure target value Pc. The pressurization by the pump 115 may also be performed on the basis of the necessary amount of pressurization calculated from a difference between the pressure target value Pc and the pressure P of the gas charged in the casing 100C at the present time point.

In the case where the pressure P of the gas charged in the casing 100C is controlled on the basis of the pressure/temperature ratio P/T and the pre-set pressure target index A, the gas is pressurized by the pump 115 until the pressure/temperature ratio P/T becomes equal to or greater than the pressure target index. In the case where the pressure P of the gas charged in the casing 100C is controlled on the basis of the temperature/pressure ratio T/P and the pre-set pressure target index B, the gas is pressurized by the pump 115 until the pressure/temperature ratio P/T becomes equal to or less than the pressure target index. Besides, the pressurization by the pump 115 may also be performed on the basis of the necessary amount of pressurization calculated from a difference between the pressure/temperature ratio P/T and the pressure target index A or from a difference between the temperature/pressure ratio T/P and the pressure target index B.

If the answer to the determination in step S104 is "NO", that is, if the control condition determination portion 32 determines P≧Pc, the Stirling engine 100 can produce the pre-established output, and therefore, the pressure control portion 33 does not pressurize the gas charged in the casing 100C of the Stirling engine 100. The engine control portion 50*h* of the engine ECU 50 starts the Stirling engine 100 for operation. Incidentally, if the state of P<Pc occurs during the operation of the Stirling engine 100, the gas charged in the casing 100C of the Stirling engine 100 may be pressurized.

As described above, according to the embodiment, in the Stirling engine in which the gas charged within the casing of the Stirling engine is pressurized beforehand, it is determined whether or not the pressure of the gas charged in the casing has declined with reference to the pressure target value of the gas. If the pressure of the gas is lower than the pressure target value, the gas is pressurized so as to compensate for the decline in the pressure of the gas with reference to the pressure target value. Therefore, the decline in the output of the Stirling engine caused by a decline in the pressure of the gas charged in the casing can be restrained.

As described above, the Stirling engine in accordance with the invention is useful as a Stirling engine in which the gas charged in the casing is pressurized beforehand, and is particularly suitable to restrain the decline in the output caused by a decline in the pressure of the gas charged in the casing.

While the invention has been described with reference to example embodiments thereof, it is to be understood that the invention is not limited to the described embodiments or constructions. On the other hand, the invention is intended to cover various modifications and equivalent arrangements. In addition, while the various elements of the disclosed invention are shown in various example combinations and configurations, other combinations and configurations, including more, less or only a single element, are also within the scope of the appended claims.

What is claimed is:

1. A Stirling engine comprising:

a casing that houses at least one component element of the Stirling engine;

a determination device that determines whether pressure of a gas charged within the casing has declined based on an index that represents a targeted pressure of the gas; and a pressure adjustment device that compensates for a decline in the pressure of the gas by pressurizing the gas, wherein the index is the pressure of the gas charged in the casing which is determined based on a temperature of the gas, and wherein the pressure adjustment device pressurizes the gas so that the pressure of the gas reaches the index.

2. The Stirling engine according to claim 1, wherein the at least one component element includes:

a cylinder;

a piston supported in the cylinder via a gas bearing; and an approximately linear mechanism that supports the piston.

3. The Stirling engine according to claim 1, wherein the index is determined based on a ratio of the pressure of the gas to temperature of the gas or a ratio of temperature of the gas to the pressure of the gas, and wherein the pressure adjustment device pressurizes the gas so that the ratio of the pressure of the gas to the temperature of the gas or the ratio of the temperature of the gas to the pressure of the gas reaches the index.

4. The Stirling engine according to claim 1, wherein before the Stirling engine is started, the determination device determines whether the pressure of the gas has declined.

5. The Stirling engine according to claim 1, wherein the index is the pressure of the gas charged in the casing which occurs when the Stirling engine produces an output that is determined from a specification of the Stirling engine.

6. The Stirling engine according to claim 1, wherein the determination device compares a gas actual pressure with the index.

7. The Stirling engine according to claim 1, wherein the gas is air.

8. A Stirling engine comprising:

a cylinder;

a piston supported in the cylinder via a gas bearing;

an approximately linear mechanism that supports the piston;

a casing that houses the cylinder, the piston and the approximately linear mechanism;

a determination device that determines whether pressure of a gas charged in the casing has declined based on an index that represents a targeted pressure of the gas; and a pressure adjustment device that pressurizes the gas, wherein the index is the pressure of the gas charged in the casing which is determined based on a temperature of the gas, and wherein the pressure adjustment device pressurizes the gas so that the pressure of the gas reaches the index.

9. A Stirling engine control method comprising:

determining whether pressure of a gas charged in a casing that houses at least one component element of a Stirling engine has declined based on an index that represents a targeted pressure of the gas; and compensating for a decline in the pressure of the gas by pressurizing the gas, wherein the index is the pressure of the gas charged in the casing which is determined based on a temperature of the gas, and wherein the gas is pressurized so that the pressure of the gas reaches the index.

* * * * *